US009617791B2

(12) United States Patent
Desai et al.

(10) Patent No.: US 9,617,791 B2
(45) Date of Patent: Apr. 11, 2017

(54) SIDETRACKING SYSTEM AND RELATED METHODS

(71) Applicant: SMITH INTERNATIONAL, INC., Houston, TX (US)

(72) Inventors: Praful C. Desai, Kingwood, TX (US); Shantanu N. Swadi, Cypress, TX (US)

(73) Assignee: SMITH INTERNATIONAL, INC., Houston, TX (US)

( * ) Notice: Subject to any disclaimer, the term of this patent is extended or adjusted under 35 U.S.C. 154(b) by 336 days.

(21) Appl. No.: 14/198,767

(22) Filed: Mar. 6, 2014

(65) Prior Publication Data

US 2014/0262528 A1 Sep. 18, 2014

Related U.S. Application Data

(60) Provisional application No. 61/785,260, filed on Mar. 14, 2013.

(51) Int. Cl.
*E21B 7/06* (2006.01)

(52) U.S. Cl.
CPC ..... *E21B 7/061* (2013.01)

(58) Field of Classification Search
CPC ..... E21B 7/06; E21B 7/061; E21B 7/062
See application file for complete search history.

(56) References Cited

U.S. PATENT DOCUMENTS 2,553,874 A 5/1951 Spaulding et al.
2,669,429 A * 2/1954 Zublin ..... E21B 7/061 175/74
2,906,499 A 4/1956 Travis
3,174,549 A 3/1965 Anderson
3,194,327 A 7/1965 Smithson
4,182,423 A 1/1980 Ziebarth et al.
4,449,595 A 5/1984 Holbert
5,431,220 A 7/1995 Lennon et al.
5,484,029 A 1/1996 Eddison
(Continued)

FOREIGN PATENT DOCUMENTS

EP 0467642 A2 1/1992
GB 2382361 A 5/2003
WO WO03071084 A2 8/2003

OTHER PUBLICATIONS

International Search Report and Written Opinion issued in PCT/US2014/021938 on Jun. 20, 2014, 14 pages.
(Continued)

*Primary Examiner* — Cathleen Hutchins

(57) ABSTRACT

A steerable drill bit may be used to drill a lateral borehole from a primary wellbore. The steerable drill bit may be part of a bottomhole assembly that also includes a directional control system. A deflection member, such as a whipstock, may be anchored in the primary wellbore. When the bottomhole assembly approaches the deflection member, the directional control system may steer the steerable drill bit to reduce and potentially eliminate contact between the steerable drill bit and a ramped surface of the deflection member. By restricting contact between the deflection member and the steerable drill bit, cutting elements of the steerable drill bit may obtain an increase in cutting efficiency and/or effective life.

18 Claims, 8 Drawing Sheets

(56) References Cited

U.S. PATENT DOCUMENTS

| | | | | |
|---|---|---|---|---|
| 6,105,675 | A * | 8/2000 | Buytaert et al. | E21B 7/061 166/117.6 |
| 6,109,372 | A | 8/2000 | Dorel et al. | |
| 6,192,748 | B1 | 2/2001 | Miller | |
| 6,279,659 | B1 | 8/2001 | Brunet | |
| 6,470,978 | B2 | 10/2002 | Trueman et al. | |
| 6,601,658 | B1 | 8/2003 | Downton | |
| 7,207,401 | B2 | 4/2007 | Dewey et al. | |
| 7,610,971 | B2 | 11/2009 | Neff | |
| 8,240,399 | B2 | 8/2012 | Kulkarni et al. | |
| 2001/0040054 | A1 * | 11/2001 | Haugen | E21B 7/061 175/61 |
| 2001/0047883 | A1 | 12/2001 | Hanton et al. | |
| 2001/0052427 | A1 | 12/2001 | Eppink et al. | |
| 2002/0050360 | A1 | 5/2002 | Cook et al. | |
| 2002/0162656 | A1 | 11/2002 | Dewey | |
| 2003/0121702 | A1 | 7/2003 | Downton et al. | |
| 2004/0244992 | A1 | 12/2004 | Carter et al. | |
| 2005/0039905 | A1 | 2/2005 | Hart et al. | |
| 2006/0027359 | A1 | 2/2006 | Carter et al. | |
| 2006/0207771 | A1 * | 9/2006 | Rios | E21B 7/061 166/382 |
| 2006/0266555 | A1 | 11/2006 | Chen et al. | |
| 2007/0187085 | A1 | 8/2007 | Dewey et al. | |
| 2008/0185148 | A1 | 8/2008 | Carter et al. | |
| 2010/0319997 | A1 | 12/2010 | King et al. | |
| 2011/0155466 | A1 | 6/2011 | Gibb et al. | |
| 2011/0155468 | A1 | 6/2011 | Gregurek et al. | |
| 2011/0308785 | A1 | 12/2011 | McGarian | |
| 2012/0222902 | A1 | 9/2012 | Alsup et al. | |
| 2012/0255785 | A1 | 10/2012 | Gregurek et al. | |
| 2012/0261193 | A1 | 10/2012 | Swadi et al. | |
| 2012/0278709 | A1 | 11/2012 | Kanzaki et al. | |
| 2013/0199784 | A1 | 8/2013 | Swadi et al. | |

OTHER PUBLICATIONS

T. B. Howes, M. Farouk, M. Darwish, W. Koroletz, A. Ismail, A. Moustafa, and G. Heisig, "Real-Time Well Tool Face Information Reduces Directional Uncertainty and Risks in Difficult Sidetracks in Gulf of Suez", SPE/IADC Drilling Conference and Exhibition, Feb. 2-4, 2010, Proceedings vol. 2; pp. 825-834.

* cited by examiner

SIDETRACKING SYSTEM AND RELATED METHODS

CROSS-REFERENCE TO RELATED APPLICATIONS

This application claims the benefit of, and priority to, U.S. Patent Application Ser. No. 61/785,260, filed on Mar. 14, 2013 and entitled "SIDETRACKING SYSTEM AND RELATED METHODS," which application is hereby incorporated herein by this reference in its entirety.

BACKGROUND

In exploration and production operations for natural resources such as hydrocarbon-based fluids (e.g., oil and natural gas), a wellbore may be drilled into a subterranean earth formation. If the wellbore comes into contact with a fluid reservoir, the fluid may then be extracted If the wellbore does not contact the fluid reservoir, or as the resources in a reservoir are depleted, it may be useful to create additional wellbores to access additional resources. For instance, another wellbore may be drilled to the downhole location of an additional fluid reservoir.

In some cases, however, directional drilling may be used in lieu of creating, a new, wellbore. In directional drilling, a new borehole may deviate from an existing wellbore. The new borehole may extend laterally at a desired trajectory suitable for reaching a particular downhole location. In creating the lateral borehole, a deflecting member may be employed in a method referred to as sidetracking.

An example deflection member may include a whipstock having a ramp surface that guide a milling bit. To create the lateral borehole, the whipstock or other deflection member can be set at a desired depth and the ramp surface oriented to provide a particular trajectory to facilitate a desired drill path. Often, one process is provided to deliver, secure and orient the whipstock within the existing wellbore. A second trip may then be used to deliver a bottomhole assembly having a milling bit. The milling bit can move along the ramp surface of the whipstock or other deflection member, and the ramp surface will guide the milling bit into the casing of a cased wellbore where a window can be milled in the casing. In the case of an uncased or openhole wellbore a drill bit may be moved into contact with the Wall of the wellbore. In either case, the milling bit or drill bit may then be extended into the surrounding subterranean formation and follow the desired path to reach a particular destination.

SUMMARY OF THE DISCLOSURE

Systems and methods of the present disclosure may relate to the drilling of a lateral borehole from a primary wellbore. In one embodiment, a method for drilling a lateral borehole may include positioning a deflection member within a wellbore. A bit may also be positioned within the wellbore, and may be coupled to a directional drilling system for selectively steering the bit. The deflection member may be anchored within the wellbore and the bit may be guided over an inclined guide surface of the deflection member, and toward a sidewall of the wellbore for drilling of a lateral wellbore. The directional drilling system may be used to elevate the bit relative to the guide surface to minimize contact between the bit and the deflection member.

In accordance with another embodiment of the present disclosure, a method for drilling a lateral wellbore in a single trip may include inserting a sidetracking assembly into a primary wellbore. The sidetracking assembly may include a whipstock assembly coupled to a bottomhole assembly that has a directional control system for controlling a steerable drill bit. The whipstock may be anchored within the primary wellbore and the whipstock may be separated from the steerable drill bit. The lateral wellbore may be drilled using the steerable drill bit, and by using the directional drilling system to control the steerable drill bit and restrict contact between the steerable drill bit and at least a portion of the whipstock assembly.

Other embodiments may include a lateral borehole drilling system that includes a drill bit and a directional drilling system for selectively steering the drill bit. A connector may couple the drill bit to a deflection member having a guide surface. One or more sensors may be provided for determining a position of the drill bit relative to the deflection member. One or more controllers may be responsive to the one or more sensors and configured to selectively control the directional drilling system to elevate the drill bit relative to the guide surface of the deflection member.

An embodiment of a directional drilling system may include a drill bit coupled to a directional drilling system for selectively steering the drill bit. The drill bit may be used in conjunction with a deflection member, such as a whipstock, which is positioned and anchored in a primary wellbore. The deflection member guides the drill bit toward a sidewall of the primary wellbore to drill the lateral borehole. The directional drilling system may be used to elevate the drill bit relative to the deflection member so as to minimize contact between the drill bit and the deflection member. In at least some embodiments, the drill bit and whipstock may be deployed in a single trip. Further, to steer the drill bit to drill the lateral borehole, one or more controllers may be used to control the directional drilling system based on the position and/or orientation of the deflection member sensed by one or more sensors.

This summary is provided to introduce some features and concepts that are further developed in the detailed description. Other features and aspects of the present disclosure will become apparent to those persons having ordinary skill in the art through consideration of the ensuing description, the accompanying drawings, and the appended claims. This summary is therefore not intended to identify key or essential features of the claimed subject matter, nor is it intended to be used as an aid in limiting the scope of the claims.

BRIEF DESCRIPTION OF DRAWINGS

In order to describe various features and concepts of the present disclosure, a more particular description of certain subject matter will be rendered by reference to specific embodiments which are illustrated in the appended drawings. Understanding that these drawings depict just some example embodiments and are not to be considered to be limiting in scope, nor drawn to scale for each potential embodiment encompassed by the claims or the disclosure, various embodiments will be described and explained with additional specificity and detail through the use of the accompanying drawings in which:

DETAILED DESCRIPTION

In accordance with some aspects of the present disclosure, embodiments herein relate to systems and methods for drilling a lateral borehole. More particularly, embodiments disclosed herein may relate to milling systems, drilling systems, and assemblies and methods for forming a lateral borehole using a steerable drilling assembly. More particularly still, embodiments disclosed herein may relate to systems and methods for setting a whipstock or other deflection member and forming a lateral borehole in a single trip, while also minimizing contact between a bit and the whipstock.

Figure 1:
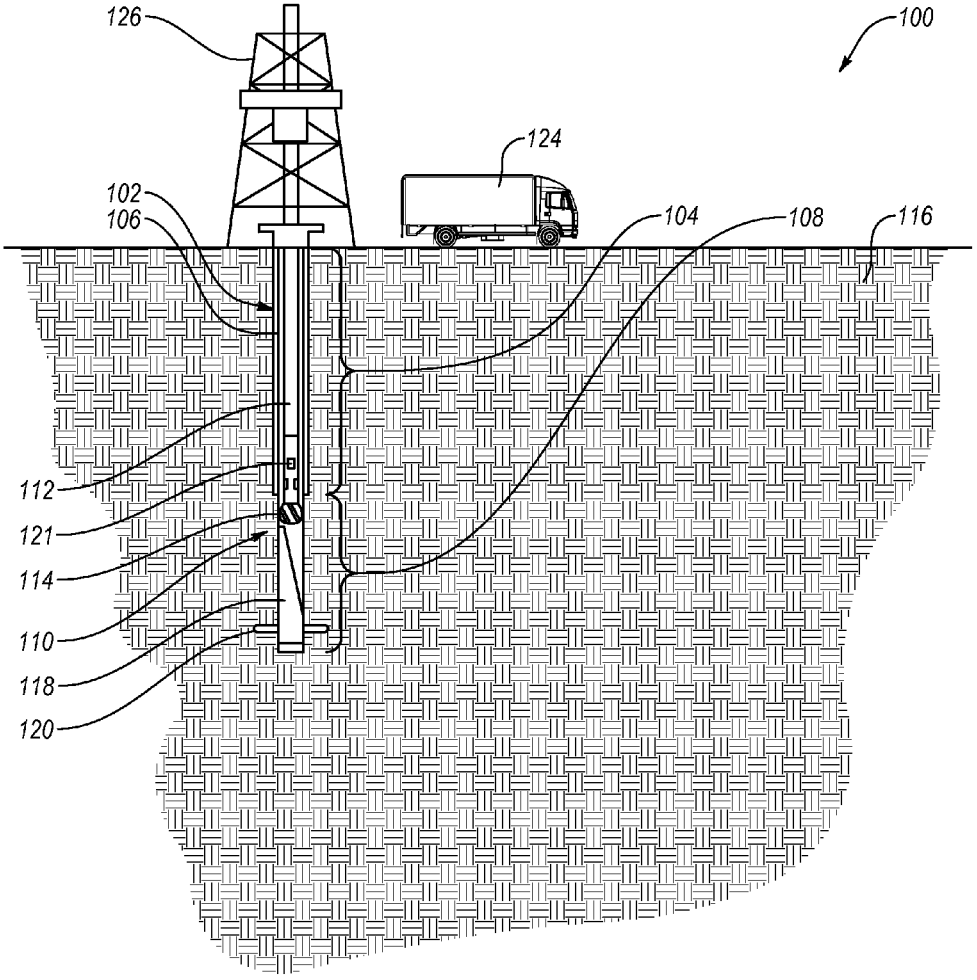
FIG. 1 schematically illustrates an example of a sidetracking system for forming a lateral borehole in a single trip, the sidetracking system including a deflection member and a downhole tool assembly, in accordance with one or more embodiments of the present disclosure.
Figure 2:
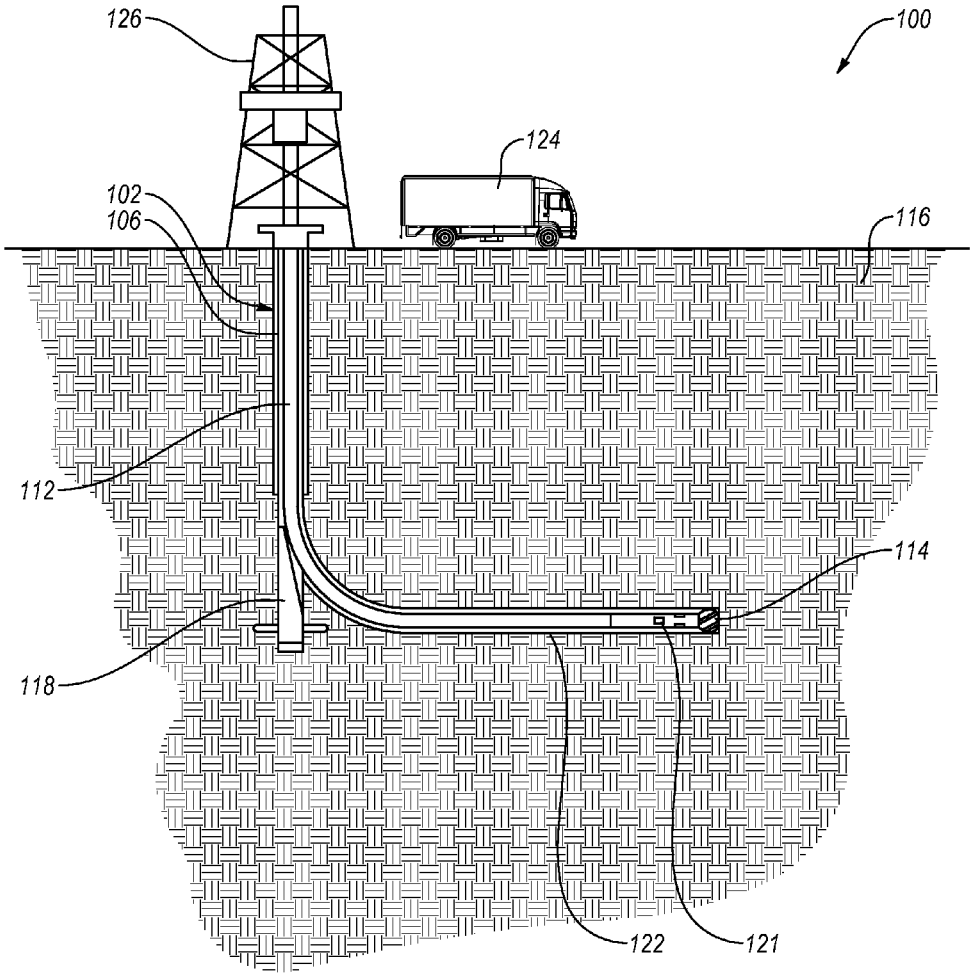
FIG. 2 schematically illustrates the sidetracking system of FIG. 1 after the formation of a lateral borehole at a desired trajectory, in accordance with one or more embodiments of the present disclosure.

Referring now to FIGS. 1 and 2, schematic diagrams are provided of an example drilling system 100 that may utilize sidetracking systems, assemblies, and methods in accordance with one or more embodiments of the present disclosure. FIG. 1 shows an example primary wellbore 102 formed in a formation 116 and having an upper section 104 with a casing 106 installed therein. In some embodiments, the primary wellbore 102 may also include an openhole section lacking, a casing 106, or multiple sections or types of casing may be used. In FIG. 1, an example openhole section is illustrated as lower section 108 of the primary wellbore 102.

In the particular embodiment illustrated in FIG. 1, a sidetracking system 110 may be provided to allow drilling of an angled or lateral borehole (e.g., lateral borehole 122 of FIG. 2) off the primary wellbore 102. The lateral borehole 122 may be drilled using a drill string 112 that is illustrated as including a tubular member with a bottomhole assembly ("BHA") attached thereto. The tubular member of the drill string 112 may itself have any number of configurations. As an example, the drill string 112 may include coiled tubing, segmented drill pipe, or the like. As used herein, a wellbore or primary wellbore refers to an existing well or hole from which a deviated or lateral wellbore is formed.

The BHA may include a bit 114 attached thereto, as shown in FIG. 1. The bit 114 may be used to drill into the formation 116 surrounding the primary wellbore 102 in order to drill a lateral borehole. In this particular embodiment, the bit 114 may include a drill bit for drilling into the formation 116 at the lower portion 108 of the primary wellbore 102, but in other embodiments, the bit 114 may be a milling bit, or a milling and drilling bit, for milling through the casing 106 before drilling through the formation 116.

To further facilitate formation of the lateral borehole 122 of FIG. 2, the sidetracking system 110 may include a deflection member 118. The deflection member 118 may include a taper, or a ramped or inclined surface for engaging the bit 114 and guiding and directing the bit. 114 into the formation 116 and/or the casing 106. The deflection member 118 may be anchored or otherwise maintained at a desired position and orientation in order to deflect the bit 114 at a desired trajectory. In one embodiment, for instance, the deflection member 118 is a whipstock having a set of anchors 120 coupled thereto. The anchors 120 may define a setting assembly for engaging the sidewalls of the lower portion 108 of the primary wellbore 102. In one embodiment, the anchors 120 may be expandable. For instance, hydraulic fluid (not shown) may be used to expand the anchors 120, which may be in the form of expandable arms, from a retracted position an expanded position which engages the sidewalls of the wellbore 102. The anchors 120 may optionally have a relatively large ratio of the expanded diameter relative to the retracted diameter, thereby facilitating engagement with a sidewall of a primary wellbore, and potentially engagement with wellbores having any number of different sizes. In other embodiments, the anchors 120 may be supplemented or replaced by other suitable components usable to secure the deflection member 118 in place. In the same or other embodiments, the deflection member 118 may be secured at a location within a cased portion of the primary wellbore 102.

The particular structure of the sidetracking system 110 may be varied in any number of manners. For instance, while the whipstock shown as the deflection member 118 may be set hydraulically, the deflection member 118 may be set in other manners, including mechanically Moreover, while the deflection member 118 is shown as having one or more generally planar ramped, tapered, or inclined surfaces, the guide surface of the deflection member 118 may actually be concave. A concave surface may, for instance, accommodate a rounded shape of the bit 114 and/or the drill string 112. In the same or other embodiments, the guide surface of the deflection member 118 may have multiple tiers or sections of differing inclines/tapers, or may otherwise be configured or designed.

In accordance with at least some embodiments of the present disclosure, the drill string 112 may include any number of different components or structures. In some embodiments, the drill string 112 may include a BHA with a motor (not shown). Example motors may include positive displacement motors, mud motors, electrical motors, turbines, or some other type of motor that may be used to rotate the bit 114 or another rotary component. The drill string 112 may also include directional drilling and/or measurement equipment. As an example, the BHA may include a steerable drilling assembly to control the direction of drilling, of the lateral borehole within the formation 116. A steerable drilling assembly may include various types of directional control systems, including rotary steerable systems such as those referred to as push-the-bit or point-the-bit systems, or any other type of rotary steerable or directional control system.

The sidetracking system 110 may also include still other or additional components. By way of example, the sidetracking system 110 may include one or more sensors, measurement devices, logging devices, or the like, which are collectively designated as sensors 121 in FIGS. 1 and 2. Examples suitable for use as the sensors 121 may include logging-while-drilling ("LWD") and measurement-while-drilling ("MWD") components, rotational velocity sensors, pressure sensors, cameras or visibility devices, proximity sensors, other sensors or instrumentation, or some combination of the foregoing.

In one example, the BHA may include a set of one or more sensors 121 that may be used to detect the position and/or orientation of the bit 114 and/or the BHA. The position and orientation may be compared relative to the location and azimuth of the deflection member 118 (e.g., the guide surface of the deflection member 118), to facilitate drilling of a lateral borehole such as the lateral borehole 122 of FIG. 2. As discussed in additional detail herein, the position and orientation of the bit 114 may also be adjustable based on the position of the deflection member 118 or the relative distance between bit 114 and the guide surface of deflection member 118 For instance, where the BHA includes a rotary steerable or directional control system, the bit 114 may be steered to reduce, and potentially eliminate, direct contact with the deflection member 118.

Where the sensors 121 provide information used to anchor the deflection member 118 and/or drill the lateral borehole 122, the information may be used in a closed loop control system. For instance, preprogrammed logic may be used to allow the sensors 121 to automatically steer the BHA, and thus the bit 114, when creating the lateral borehole 122. In other embodiments, however, the control system may be an open loop control system. Information may be provided from the sensors 121 to a controller (e.g., at the surface or disposed in the BHA) or operator (e.g., at the surface). The controller or operator may review or process data signals received from the sensors 121, and provide instructions or control signals to the control system to direct drilling of the lateral borehole 122 and/or anchoring of the deflection member 118. The sensors 121 may therefore also include controllers, positioned downhole or at the surface, configured to vary the operation of (e.g., steer) the bit 114 or other portions of the BHA. Mud pulse telemetry, wired drill pipe, fiber optic coiled tubing, wireless signal propagation, or other techniques may be used to send information to or from the surface.

In FIGS. 1 and 2, information obtained about the position, orientation, or other status of the deflection member 118 and/or bit 114 may be provided to an operations center 124, which is here illustrated as a mobile operations center. In other embodiments, however, an operations center 124 may be fixed. For instance, the illustrated embodiment of a drilling system 100 may include a rig 126 used to convey the drill string 112 into the primary wellbore 102. A command or operations center, or other controller, may be at a relatively fixed location, such as on the rig 126 Optionally, the operations center 124, whether fixed or mobile, and whether local or remote relative to the primary wellbore 102, may include a computing system that includes a controller to receive and process the data transmitted uphole by the BHA. Further, while the rig 126 is shown as a land rig, the system 100 may alternatively use other types of rigs or systems, including offshore rigs.

Figure 3:
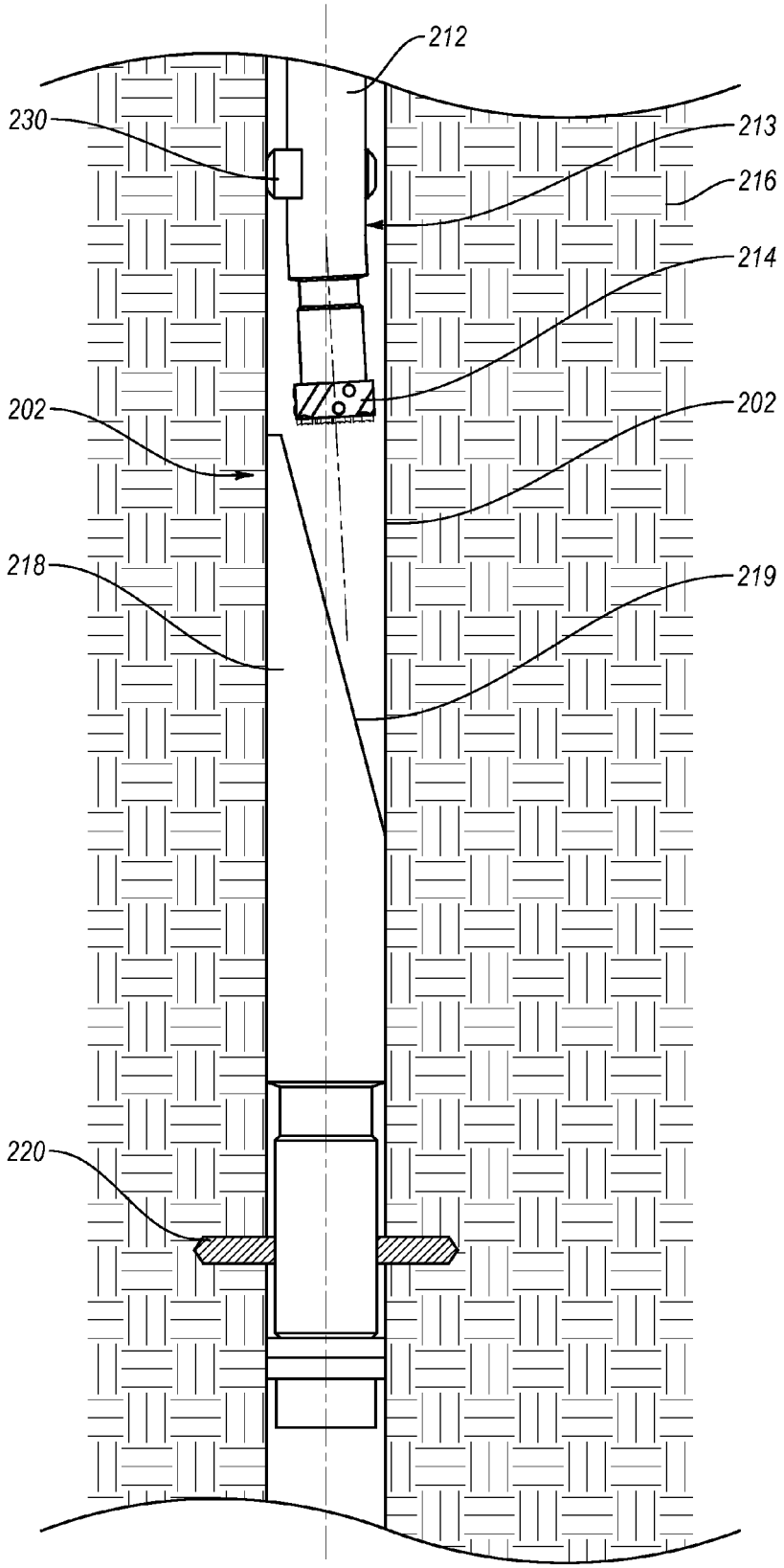
FIG. 3 illustrates a partial cross-sectional view of an example sidetracking system for drilling a lateral borehole, the sidetracking system including a deflection member and a steerable drilling assembly, in accordance with one or more embodiments of the present disclosure.
Figure 4:
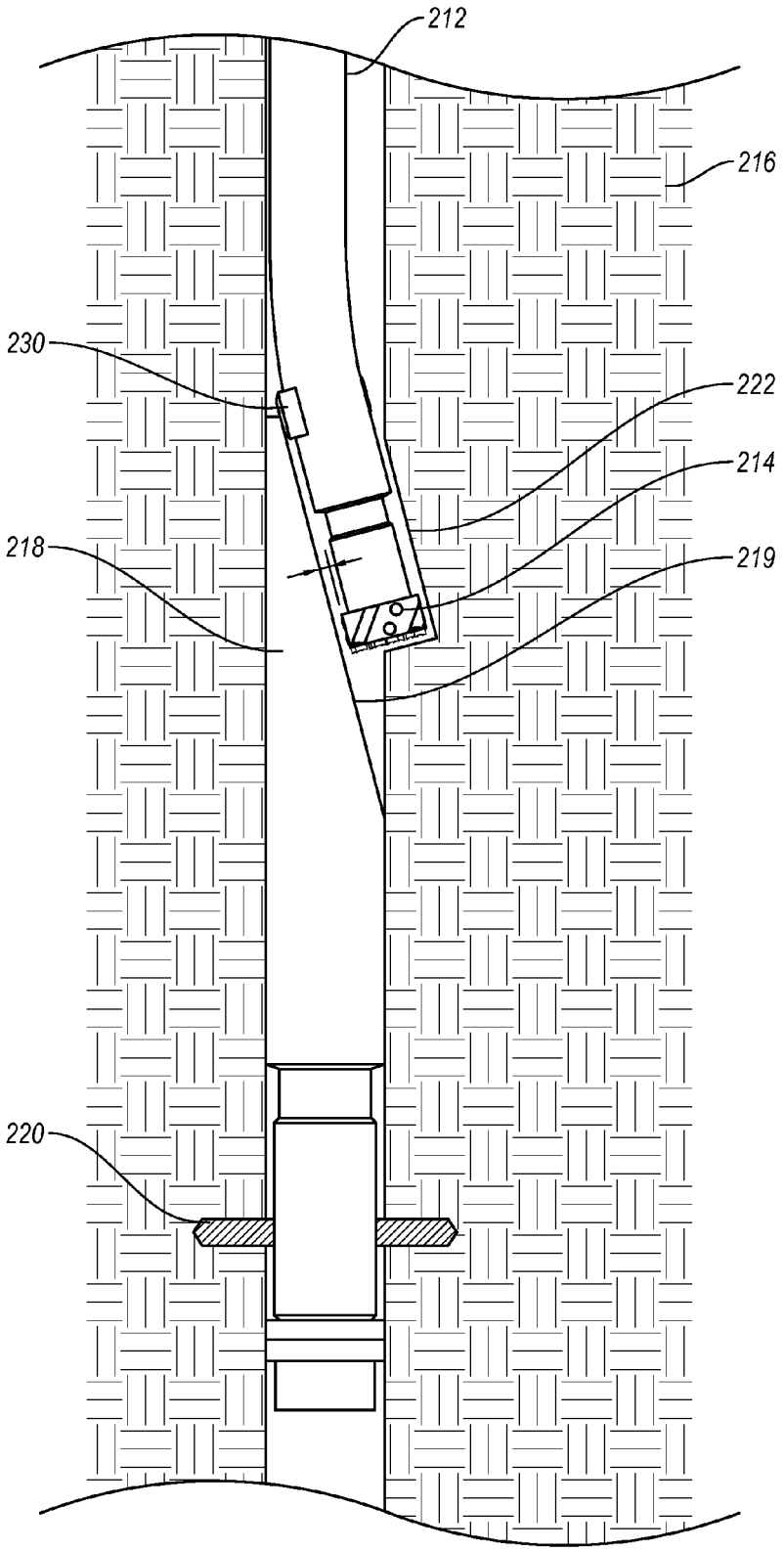
FIG. 4 illustrates a partial cross-sectional view of the sidetracking system of FIG. 3, and includes the steerable drilling assembly guiding a drill bit to drill a lateral borehole while elevating a drill bit off an ramp surface of the deflection member, in accordance with one or more embodiments of the present disclosure.
Figure 5:
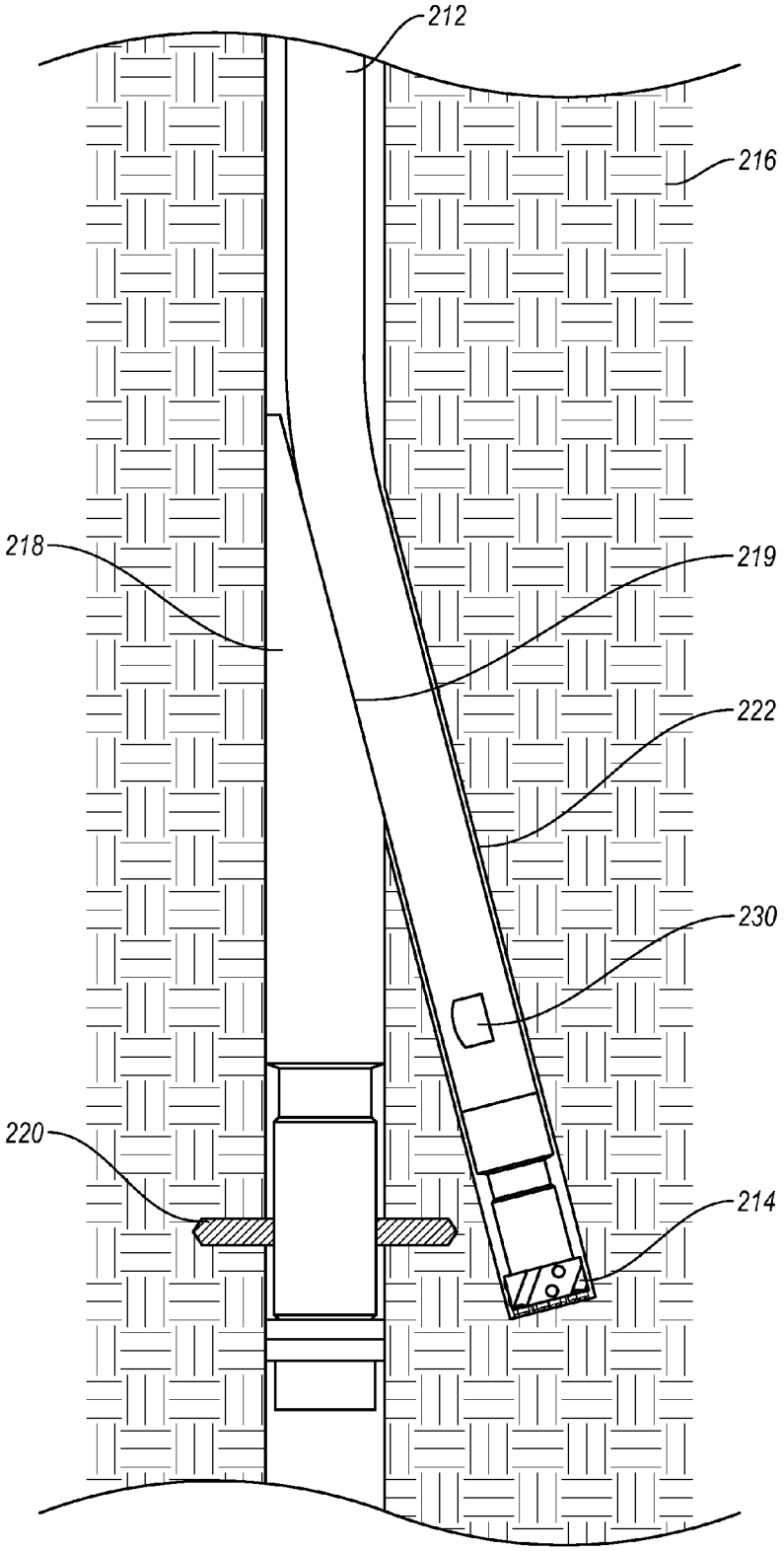
FIG. 5 illustrates a partial cross-sectional view of the sidetracking system of FIGS. 3 and 4, as the drill hit drills a lateral borehole extending from a primary wellbore, in accordance with one or more embodiments of the present disclosure.

Turning now to FIGS. 3-5, various cross-sectional views are provided to illustrate stages of drilling a lateral borehole 222 off of or from a primary wellbore 202. In each of FIGS. 3-5, the illustrative primary wellbore 202 is shown as a vertical wellbore that has been formed in a formation 216 It should be appreciated in view of the disclosure herein, however, that the primary wellbore 202 need not be vertical, and can be oriented at any desired angle, or may even change angles. Additionally, the illustrated primary wellbore 202 is shown as being an openhole wellbore, such that sidetracking or other drilling of a lateral borehole may be performed by drilling directly into the formation 216, and potentially without milling through a casing or other similar component. In other embodiments, however, the primary wellbore 202 may be a cased wellbore.

The embodiments of FIGS. 3-5 are shown as including a drill string 212 tripped into the primary wellbore 202. A BHA 213 may be attached to a lower end portion of the drill string 212, and may include a steerable drill bit 214 in some embodiments. While referred to as a drill bit, the drill bit 214 may include a milling bit, or a milling and drilling bit for a cased wellbore.

The drill bit 214 is shown somewhat schematically, and can include one or more cutters, blades, or rollers for drilling into the formation 216. The drill hit 214 may be used to drill into a sidewall of an openhole portion of the primary wellbore 202 to begin drilling a lateral borehole. As noted herein, in other embodiments, the drill bit 214 may be used as a mill to cut a window in to a casing tee FIG. 6).

The drill bit 214 may rotate to drill into the formation 216. Rotation may be achieved by rotating the drill string 212 or in other manner. For instance, in one embodiment, a motor (e.g., a mud motor) or a turbine may be used to rotate a drive shaft inside the drill string 212, with the drive shaft causing rotation of the drill bit 214 and such rotation optionally being independent of rotation of the drill string 212.

FIGS. 3-5 also somewhat schematically illustrate a side view of an example deflection member 218, which in this embodiment is shown as a whipstock. The deflection member 218 may be secured at a desired location and azimuth within the primary wellbore 202. In some embodiments, for instance, the deflection member 218 may include a setting assembly, which in this embodiment includes anchors 220. The anchors 220 may be selectively expandable and/or retractable, as discussed in greater detail herein. Generally speaking, the anchors 220 may be in a retracted state (not shown) when the deflection member 218 is tripped into the primary wellbore 202. Upon reaching a desired depth and when oriented at the desired azimuth, the anchors 220 can be expanded to secure the deflection member 218 in place by engaging the formation around primary wellbore 202.

The deflection member 218 may also include a guide surface 219 having, one or more inclined surfaces, tapers, or ramps. When anchoring the deflection member 218 in place, the guide surface 219 may be positioned at a desired orientation configured to guide the drill bit 214 and BHA 213 along a particular trajectory. The guide surface 219, as shown, may generally include a taper, ramp, or inclined surface such that a width of the deflection member 218 increases from an upper end portion towards a lower end portion. As a result, as the BHA 213 is moved downward into the primary wellbore 202, the guide surface 219 can urge the drill bit 214 outwardly against the formation 216. As can be seen in FIG. 4, for instance, the drill bit 214 can generally follow the incline of the guide surface 219, a single ramp or taper in this embodiment, and engage the formation 216. As the guide surface 219 urges the drill bit 214 into contact with the formation 216, the drill bit 214 can begin drilling a lateral borehole 222 therein.

The guide surface 219 can have any suitable shape or configuration. As discussed herein, for instance, the guide surface 219 may have a concave portion (not shown), a planar portion, multiple sections of differing inclination or taper, some other configuration, or some combination of the foregoing. In one embodiment, the guide surface 219, or a portion thereof, may be angled to deflect the drill bit 214 at a desired trajectory and into the formation 216. In FIGS. 3-5, for instance, the deflection member 218 is oriented so that the guide surface 219 is at an angle relative to the longitudinal axis of the primary wellbore 202, with the angle being measured in a counterclockwise direction. In other embodiments, however, the deflection member 218 may be otherwise oriented. The angle of the guide surface 219 could, for instance, be measured relative in a clockwise direction relative to the longitudinal axis of the primary wellbore 202.

The particular degree at which the guide surface 219, or a portion thereof, is inclined may be varied in different embodiments. For instance, in one embodiment, the guide surface 219, or a portion thereof, may have an incline between about 1° and about 10° relative to the longitudinal axis of the primary wellbore 202. In another embodiment, the guide surface 219, or a portion thereof, may be inclined at about 3°. In still other embodiments, the guide surface 219, or a portion thereof, may include a ramp or taper with an angle of less than about 1°, or greater than about 10°, relative to the longitudinal axis of the primary wellbore 202. In still other embodiments, the guide surface 219 may include a plurality of ramps/tapers with each ramp/taper extending at various angles of between less than 1° up to less than about 45°. The incline of various sections of the guide surface 219 may, for instance, each be between about 1° and about 15° or between about 2° and about 5° relative to the longitudinal axis of the primary wellbore 202.

As the drill bit 214 travels across the guide surface 219 and contacts the formation 216, the drill bit 214 may begin to create the lateral borehole 222 at the desired trajectory. As shown in FIG. 5, the lateral borehole 222 can be drilled and deflected by the deflection member 218 at an angle that generally corresponds to the angle of the corresponding portion of the guide surface 219.

In accordance with some embodiments of the present disclosure, the BHA 213 may include a directional drilling system. Using a directional drilling system, the drill bit 214 may be used, in addition to the deflection member 218, to further control the direction of the lateral borehole 222. For instance, the directional drilling system of the BHA 213 may steer the drill bit. 214 to create a lateral borehole 222 that ultimately travels in about a horizontal direction within the formation 216, or in other words, in a direction that may be about perpendicular to the primary wellbore 202 (see, e.g., lateral wellbore 122 of FIG. 2) The deflection member 218 may therefore be used to deflect the drill bit 214 into the formation 216 to begin the lateral borehole 222, while the directional drilling system of the BHA 213 may then continue to turn or steer drill bit 214 to continue a dogleg and produce a lateral borehole 222 that extends to a desired location. In other embodiments, the lateral wellbore 222 may not reach a horizontal direction or may even pass beyond horizontal to move slightly upwardly.

In some embodiments, the deflection member 218 may be used contact the drill bit 214 and push the drill bit 214 into the formation 216. Contact with the deflection member 218 may damage the drill bit 214. When damage occurs, the effectiveness and useful life of the drill bit 214 may be reduced. To reduce the damage to the drill bit 214, some embodiments of the present disclosure contemplate using a directional drilling, system to reduce, restrict, and potentially eliminate, contact between the drill bit 214 and the deflection member 218.

More particularly, and again with reference to FIG. 3, an embodiment of the present disclosure contemplates use of a BHA 213 having a directional drilling system that includes a steering assembly having a set of steering pads 230. The steering pads 230 may have any number of configurations and can operate in a number of different manners. For instance, the steering, pads 230 may be expandable in a radial direction relative to the BHA 213, so as to increase the effective diameter of the BHA 213 at the location or position of the steering pad 230.

The steering pads 230 may each be individually controllable. For instance, two or more steering, pads 230 may be spaced around the peripheral surface of the BHA 213. Each steering pad 230 may be individually expandable. Such expansion may occur through mechanical actuation or in other manners. For instance, hydraulic pressure may be delivered through the drill string 212 and supplied to the steering pads 230 through one or more nozzles, jets, valves, or other features, or some combination hereof. For instance, a valve associated with one steering pad 230 may be opened to allow expansion of the corresponding steering pad 230. At the same time that one steering pad 230 is expanded, another steering pad 230 may be in a retracted position, or may be transitioning from an expanded to a retracted position.

More particularly, the steering pads 230 may be used to move the drill bit 214 along a desired trajectory. For instance, to reach a desired fluid reservoir, it may be desirable to have a lateral borehole 222 extend to the right of the primary wellbore 202, according to the orientation shown in FIGS. 3-5. To facilitate formation of the lateral borehole 222 in the desired direction, the steering pads 222 may be used to push the drill bit 214 in the desired direction. Thus, in FIG. 3, the steering pad 230 on the left side of the primary wellbore 202 may be expanded, while the steering pad 230 on the right side of the primary wellbore 202 may be retracted. The expanded left side steering pad 230 may effectively push the drill bit 214 to the right and change the angle of the BHA 213. As shown in FIG. 3, for instance, the centerline of the drill bit 214 may be pushed away from the vertical as it approaches the deflection member 218. In embodiments in which the BHA 213 is rotating, the various steering pads 230 may be alternately expanded and retracted during each rotation of the BHA 213.

The steering pads 230 may therefore be one example of a directional drilling system for steering the drill bit 214, and the drill bit 214, directionally controlled by the steering pads 230, is one example of a steerable drill bit. Control of the directional drilling system may be automated or manual, and may be controlled downhole or at a surface. For instance, one or more sensors (e.g., sensors 121 of FIG. 1) may detect a position of the drill bit 214 relative to the surface and/or the deflection member 218 (e.g. the guide surface 219 thereof). As disclosed herein, that information may be processed in a closed loop control system coupled to or within the directional drilling system, or data may be sent in an open loop to a controller or operator at the surface. Regardless of the particular control configuration, as the drill bit 214 nears the deflection member 218 (see FIG. 3), a controller or operator can provide signals (e.g., to a hydraulic actuator) to expand desired steering pads 230 to engage the sidewalls of the primary wellbore 202 and to begin pushing the drill bit 214 off-center and towards a side of the primary wellbore 202 where the lateral borehole 222 is to be drilled. In doing so, the steering pads 230 may also push the drill bit 214 away from the guide surface 219 of the deflection member 218. Consequently, when the drill bit 214 reaches the guide surface 219, the drill bit 214 may be elevated from the guide surface 219, potentially minimizing, restricting, or even eliminating direct contact therewith.

As shown in FIG. 4, as the drill string 212 continues to move downward, the drill bit 214 may move further into the primary wellbore 202, and further along the deflection member 218 In some embodiments, the steerable pads 230 may be used to continue pushing the drill bit. 214 away from the guide surface 219, thereby minimizing, restricting, or eliminating contact therewith. The amount by which the steerable pads 230 are expanded may optionally vary as the BHA 213 approaches the deflection member 218, or the expansion may be generally constant. Further, as the steering pads 230 move downwardly, they may also align with, and potentially contact, the guide surface 219. A controller or operator may continue to expand the steering pads 230 in such a configuration, as shown in FIG. 4. In doing so, the directional drilling, system of the BRA 213 may continue to elevate the drill bit 214 from the face of the guide surface 219. The particular amount by which the drill bit 214 is elevated may vary. For instance, the drill bit 214 may be pushed and lifted from the face of the guide surface 219 by an amount up to about three inches (76 mm). More particularly, the drill bit 214 may be lifted from the face of the guide surface 219 by an amount up to about half an inch (13 mm), in other embodiments, the drill bit 214 may be lifted from the face of the guide surface 219 by an amount greater than three inches (76 min) or less than about half an inch (13 mm) Optionally, the steering pads 230 continue to elevate the drill bit 214 along at least some, and potentially a full length, of the guide surface 219. Once the drill bit 214 begins drilling the lateral borehole 222 within the formation 216, the steering pads 230 may each retract to cease separating the drill bit 214 from the guide surface 219. Of course, the steering pads 230 may also be used to further change a direction of the lateral borehole 222, and may thus also continue to be expanded and retracted along potentially the full length of the guide surface 219 and/or the full length of the lateral borehole 222.

The particular structure of the steering pads 230 may be varied in any number of manners. For instance, in some embodiments, the steering pads 230 are secured to the BHA 213 above the drill bit 214. The particular distance between the steering pads 230 and the drill bit 214 may vary. In general, however, the closer the steering pads 230 are to the drill bit 214, the more sharply they can turn and push the drill bit 214 Indeed, some embodiments contemplate placing the drilling pads 230 adjacent to or even within the drill bit 214. Moreover, the steering pads 230 may translate radially outward, or may rotate (e.g., using a hinge or pin) to expand radially outward.

Steering the drill bit 214 to create separation with the deflection member 218 and/or performing directional drilling and changing the trajectory of a lateral borehole 222 may be done in a number of different manners. FIGS. 3-5 contemplate an example push-the-bit, directional control system that includes expandable steering pads 230 as discussed herein. In another embodiment, however, FIG. 6 illustrates an example point-the-bit directional control system for controlling a bit 314 As discussed herein, steering the bit 314 may be used to reduce, and potentially eliminate, contact between the bit 314 and a deflection member 318, to change the trajectory of a lateral borehole, or both.

Figure 6:
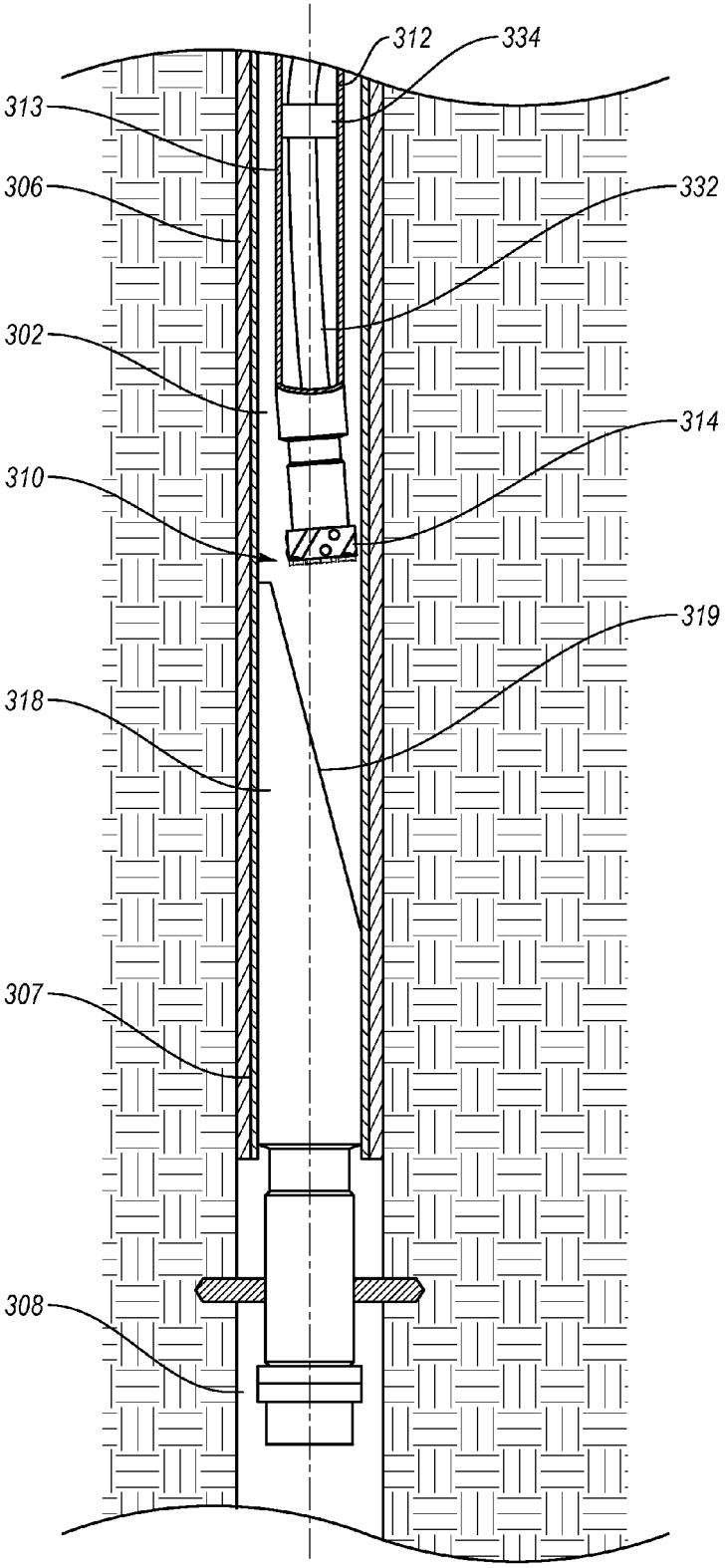
FIG. 6 illustrates another example of a sidetracking system for drilling a lateral borehole, the sidetracking system including a deflection member and a steerable drilling assembly, in accordance with another embodiment of the present disclosure.

In the particular embodiment illustrated in FIG. 6, a sidetracking system 310 may include a drilling assembly and a deflection member 318. The deflection member 318 may generally be similar to other deflection members described herein, or may have any other suitable construction to assist in forming, a lateral borehole off of or from a primary wellbore 302. Similar to the embodiment shown in FIGS. 3-5, the sidetracking system 310 may be used to drill into an openhole wellbore and create a lateral borehole. In other embodiments, however, the lateral borehole may extend from a cased wellbore. FIG. 6, in particular, illustrates an example in which the primary wellbore 302 may include a lining (e.g., casing 306) along at least a portion thereof. Optionally, an annular column of cement (not shown) may be positioned in the annulus between the casing 306 and the surrounding formation 316. As also shown in FIG. 6, a coating 307 or other material may also optionally be placed on the interior surface of the casing 306. Such a coating 307 may be used in some applications to provide desired frictional wear, fluid flow, or other properties. Of course, the coating 307 may also be excluded or replaced by other components (e.g., a particular surface treatment of the interior surface of the casing 306). Additionally, while the casing 306 may extend a full length of the primary wellbore 302, in other embodiments it may extend a partial length (e.g., creating an uncased portion 308 of the primary wellbore 304).

The drilling assembly in the sidetracking system 310 of FIG. 6 may include a drill string 312 attached to a BHA 313. In this embodiment, the BHA 313 is shown partially in cross-section to illustrate an optional interior drive shaft 332. The drive shaft 332 may be flexible. In one embodiment, the interior drive shaft 332 may pass through a ring 334. The ring 334 is optionally eccentric, such as by positioning an interior opening off-center within the ring 334. By rotating or otherwise moving the ring 334, the drive shall 332 may change positions with respect to a longitudinal axis of the drill string 312 and/or the BHA 313 Multiple rings 334 may optionally be used. With multiple rings 334, the drive shaft 332 may flex or bend. The drive shaft 332 may be linked or coupled to the bit 314. As a result, when the drive shaft 332 bends, the bit 314 may also be reoriented. In this particular embodiment, the center line of the hit 314 is shown as being inclined or offset relative to the center line of the primary wellbore 302 as a result of flexure in the drive shall 332.

In a manner similar to that described relative to the embodiment shown in FIGS. 3-5, the drive shall 334 may be controlled to selectively point the bit 314 in a manner that reduces, and potentially eliminates, contact of the bit 314 and guide surface 319 of the deflection member 318 Indeed, whether a bit 314 is steered using a push-the-bit directional control system (see FIGS. 3-5), a point-the-bit control system (see FIG. 6), or some other directional control system, the bit 314 may be controlled using one or more sensors, controllers, other devices, or some combination thereof. Such devices may be used to coordinate movement of the bit 314 with the location of the guide surface 319. Thus, similar to the method illustrated in FIGS. 3-5, the bit 314 may minimize, restrict, or avoid contact with the guide surface 319 while drilling a lateral borehole. In the particular embodiment illustrated in FIG. 6, the sidetracking system 310 may also be used to minimize, if not wholly eliminate, contact between the bit 314 and the guide surface 319 while also milling a window in the casing 306 in order to begin drilling the lateral borehole into the formation 316

Other considerations may also be used in designing or using a directional drilling system as discussed herein. For instance, a steerable system (e.g., a rotary steerable system using push-the-bit, point-the-bit, or other steering systems may be used in connection with additional control systems to minimize or avoid, contact between the deflection member 318 and the bit 314. For instance, the build rate may be increased to reduce the amount of time the bit 314 travels over or along the guide surface 319 of the deflection member 318. In other embodiments, however, control of the bit 314 may be easier with a lower build rate, in which case the build rate may be reduced. The incline angle(s) of the guide surface 319, the length of the guide surface 319, and other factors may also be used to minimize contact between the guide surface 319 and the bit 314. In some embodiments, the configuration of the guide surface 319 (e.g., length, angle, etc.), directional drilling system of the BHA 313, and the like may be used to minimize travel time of the bit 314 over the guide surface 319, and also to achieve a predetermined build rate. Further considerations may also be used. For instance, with reference to the BHA 213 of FIG. 3, the steering pads 230 may include a coating or other material, a float, or other component. Such a component may facilitate movement of the steering pads 230 over face of the guide surface 219, and may also be used in minimizing hit travel time and/or achieving a predetermined build rate.

In accordance with one or more embodiments of the present disclosure, a deflection member and a bit may be deployed into a primary wellbore in separate trips. For instance, a deflection member may be attached to a drill string and tripped into the primary wellbore. Upon anchoring the deflection member, the drill string may release or be released from the deflection member and be removed from the well. Thereafter, the bit used to drill the lateral borehole and/or mill a window in the casing may be tripped into the wellbore.

Figure 7:
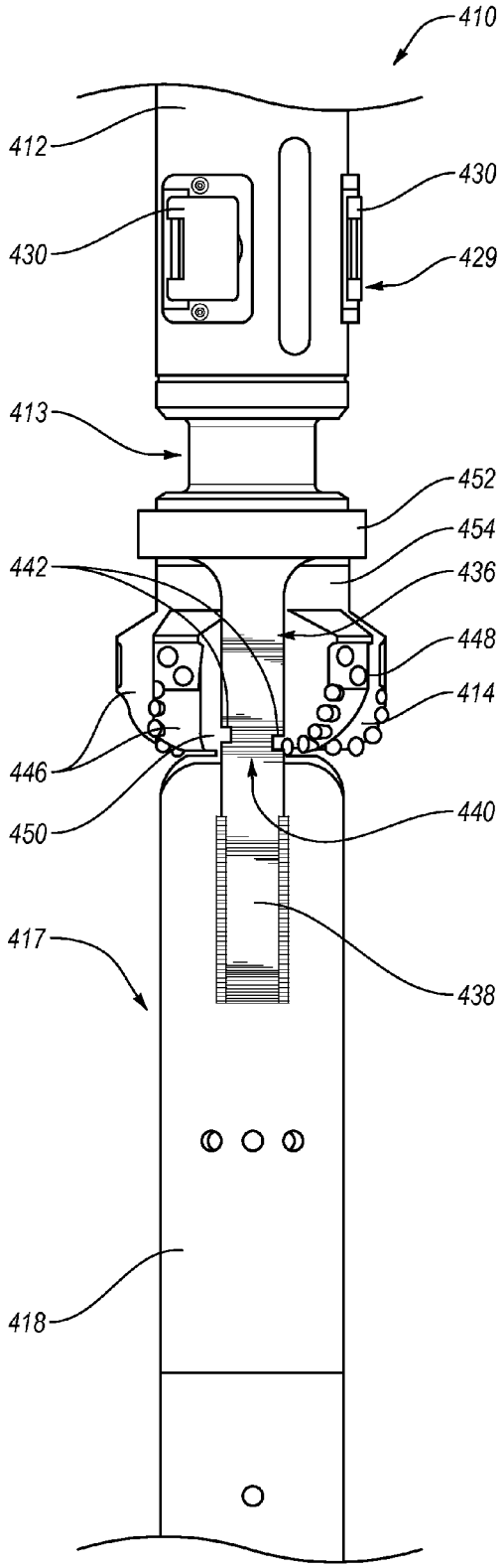
FIG. 7 illustrates an side view of a sidetracking assembly for drilling a lateral borehole, the sidetracking assembly including a deflection member coupled to a drill bit, in accordance with one or more embodiments of the present disclosure.
Figure 8:
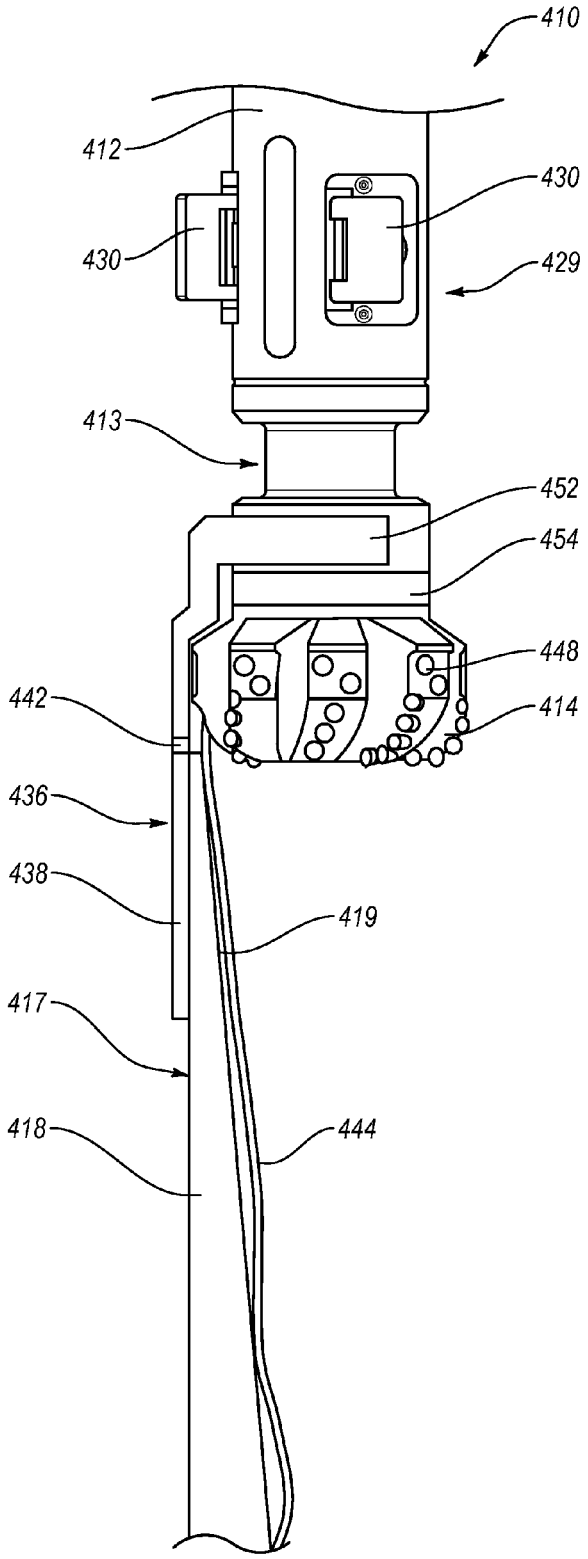
FIG. 8 illustrates a side view of the sidetracking assembly illustrated in FIG. 7, in accordance with one or more embodiments of the present disclosure.

In accordance with one or more embodiments of the present disclosure, a deflection member and a bit may be deployed into a primary wellbore to drill at least a partial lateral borehole in a single trip. FIGS. 7 and 8 illustrate an example embodiment of a sidetracking assembly 410 that may be used for single trip formation of a lateral borehole.

In particular, the sidetracking assembly 410 of FIGS. 7 and 8 may generally be used to drill a lateral borehole in a single trip, and includes a drill bit 414 coupled to a whipstock assembly 417 that includes a whipstock 418 or other deflection member. The drill bit 414 may be coupled to the whipstock assembly 417 using a connector 436. In this particular embodiment, the connector 436 may include a longitudinal member 438 extending between the drill bit 414 and the whipstock 418 of the whipstock assembly 417. The connector 436 may also include a separation element 440 for enabling separation of the whipstock assembly 417 from the drill bit 414 when the whipstock assembly 417 is positioned and anchored at a desired location and azimuth. In this particular embodiment, the separation element 440 may include one or more shear elements, such as a groove or notch 442, disposed in the longitudinal member 438 of the connector 436. The notches 442 or other shear elements may enable separation by shearing of the connector 436 into upper and lower portions upon application of a force or load upon the connector 436 Such a force may be provided by, for instance, pulling up on the drill string 412 coupled to the connector 436 following anchoring of the whipstock 418. The connector 436 may be configured to shear or separate at a force that is less than the holding capacity of the anchor coupled to the whipstock 418.

According to one embodiment of the present disclosure, the sidetracking assembly 410 may be conveyed downhole to a desired location and rotated to a desired orientation/azimuth in a primary wellbore The orientation may be determined based on a desired trajectory for drilling of a lateral borehole. An anchor or other setting system of the whipstock assembly 417 may be actuated. For instance, hydraulic fluid may be delivered downhole via the drill string 412 and conveyed to the whipstock assembly 417. As shown in FIG. 8, for instance, a hydraulic line 444 may extend to the whipstock assembly 417 from the drill bit 414 or another component of the BHA 413 The hydraulic line 44 may extend to an anchor (not shown). The hydraulic, fluid can apply hydraulic pressure and set the anchor against the surrounding wellbore sidewall, thereby securing the whipstock 418 at a desired location and orientation.

An upward force may thereafter be applied to the drill bit 414 using the drill string 412, or the drill bit 414 may be rotated or otherwise loaded to shear the connector 436 at the separation element 440. Upon separation from the whipstock assembly 417, the drill bit 414 may be moved along a ramp or other face of a guide surface 419 of the whipstock 418, which is arranged to urge and guide the drill bit 414 into the sidewall of the primary wellbore for drilling of a lateral borehole. In at least some embodiments, the whipstock assembly 417 may be anchored to an openhole portion (i.e., non-cased portion) of a primary wellbore. In such an embodiment, the drill bit 414 may also drill into an openhole portion of the primary wellbore. In another embodiment, however, the drill bit 414 may mill through a casing and into the formation following creation of a window in the casing, whether or not the whipstock assembly 417 is anchored to an openhole or cased portion of the primary wellbore.

With additional reference to FIGS. 7 and 8, the illustrated drill hit 414 is illustrated as a polycrystalline diamond compact ("PDC") drill bit, although the BHA 413 may be used in connection with a variety of types of drill bits. In this particular embodiment, the drill bit 414 may include a plurality of blades 446, each of which may have a plurality of cutters 448. The cutters 448 may include PDC elements arranged to drill a lateral borehole over a distance to a target location. The blades 446 may each be arranged circumferentially around the drill bit 414 and separated by a set of junk channels 450 to facilitate removal of the cuttings. One or more nozzles (not shown) may also be located at the distal end portion of the drill bit 414 to direct drilling fluid downwardly to further assist in removing of cuttings and/or cooling the drill bit 414.

In this particular embodiment, an upper end portion of the connector 436 is coupled to the drill bit 414 using a collar 452 that extends around some or the full circumferential surface of a shank 454 of the drill hit 414. The lower portion of the connector 436 may be coupled to the whipstock 418 in any suitable manner, including using mechanical fasteners, although the illustrated embodiment illustrates a weld acting as a fastener.

The collar 452 may be coupled to the shank 454 at a location that does not interfere with the operation of the drill hit 414, and is shown in FIGS. 7 and 8 as being located above the uppermost cutter 448. The collar 542 may be secured in place in any desirable manner, such as through the use of bolts, clamps, or other mechanical fasteners, although the collar 452 may be secured in other manners as well (e.g., welding). In other embodiments, the collar 452 may be omitted and the connector 436 may be secured to the drill bit 414 in other manners. In at least some embodiments, the connector 436 may extend between adjacent blades 446 of the drill bit 414—such as in a junk slot 450—although a connector 436 may extend from the drill bit 414 to the whipstock 418 in arty number of manners.

As discussed herein, the longitudinal member 438 may be sheared, broken, or otherwise separated to separate the whipstock assembly 417 from the drill bit 414 and BHA 413. After separation, a portion of the longitudinal member 438 may remain coupled to the shank 454, while another portion may remain coupled to the whipstock 418. In this embodiment, the separation element is located proximate the bottom end portion of the drill bit 414 and the upper end portion of the whipstock assembly 417, such that an upper portion of the longitudinal member 438 may remain within a junk slot 450 following separation of the connector 436. In other embodiments, however, the separation element 440 may be otherwise located. For instance, the notches 442 or other shear elements may be positioned at or near the shank 454 to reduce a portion of the connector 436 that remains coupled to the drill bit 414.

The sidetracking system 410 illustrated in FIGS. 7 and 8 may be used in connection with any number of systems and methods for drilling a lateral borehole. For instance, as discussed herein, the whipstock 418 may be anchored in an openhole location of a primary wellbore. By twisting or pulling, on the drill string 412, the connector 426 can be sheared to release the drill bit 414 from the whipstock 418. Thereafter, the drill bit 414 can pass over the face of the guide surface 419 to drill a lateral borehole in an openhole portion of a primary wellbore, or through a window formed in a casing, of the primary wellbore. As discussed herein, the sidetracking, system 410 may also be used to minimize, and potentially eliminate, contact between the drill bit 414 and the guide surface 419 as the drill bit begins to drill the lateral borehole.

More particularly, the BHA 413 shown in FIGS. 7 and 8 illustrates a directional drilling system 429 that may be used to steer the drill bit 414. In this particular embodiment, the directional drilling system 429 may include a set of steering pads 430. The illustrated steering pads 430 are circumferentially offset around a body of the BHA 413, and may be positioned in expanded or retracted positions. In FIG. 7, for instance, two illustrated steering pads 430 are each shown in a retracted position. In FIG. 8, however, one of the steering pads 430 is shown in an example expanded position. To transition to the expanded position, hydraulic fluid may be selectively delivered to the steering pad 430. The hydraulic fluid may rotate the steering pad 430 outwardly to increase the maximum radius of the BHA 413 at the location of the expanded steering pad 413 In some embodiments, a single steering pad 430 is expanded at a particular time, or the steering pads 430 are alternately transitioned between expanded and retracted positions to steer the bit. The steering pads 430 may be an example of a push-the-bit steering system, and can operate in a manner similar to that illustrated and described herein relative to FIGS. 3-5.

Upon separation of the drill bit 414 from the whipstock 426, the drill string 412 may be used to lower the drill bit 414 towards the guide surface 419 of the whipstock 426. As the drill bit 414 approaches the guide surface 419, a steering pad 430 on the opposite side as the intended direction of travel may expand and contact the interior wall of the primary wellbore. The contact may push the drill bit 414 toward the direction of travel and away from the face of the guide surface 419 Optionally, the drill bit 414 and/or BHA 413 may rotate so that different steering pads 430 alternately expand and retract, and push against the primary wellbore to push the drill bit 414 and restrict or prevent the drill bit 414 from contacting the guide surface 419. As the BHA 41.3 continues to move downwardly, the steering pads 430 may continue to push the drill bit 414 away from the face of the guide surface 419 and may be used to build a curve into a formation at a trajectory leading a lateral borehole to a desired target location.

The various embodiments discussed herein may be used in combination, and various features disclosed in one embodiment are intended to be usable in connection with other embodiments disclosed herein. For instance, while FIGS. 7 and 8 illustrate a sidetracking system 410 that includes a steerable BHA using steering pads to push a drill bit 414, the sidetracking system 410 could also include a steerable BHA using a flexible shaft or other mechanism to point the bit (see FIG. 6).

While embodiments herein have been described with primary reference to downhole tools and drilling rigs, such embodiments are provided solely to illustrate one environment in which aspects of the present disclosure may be used. In other embodiments, sidetracking systems, steerable drilling systems, other components discussed herein, or which would be appreciated in view of the disclosure herein, may be used in other applications, including in automotive, aquatic, aerospace, hydroelectric, or other industries.

In the description herein, various relational terms are provided to facilitate an understanding of various aspects of some embodiments of the present disclosure. Relational terms such as "bottom," "below," "top," "above," "back," "front," "left", "right", "rear", "forward", "up", "down", "horizontal", "vertical", "clockwise", "counterclockwise," "upper", "lower", and the like, may be used to describe various components, including their operation and/or illustrated position relative to one or more other components. Relational terms do not indicate a particular orientation for each embodiment within the scope of the description or claims. For example, a component of a BHA that is "below" another component may be more downhole while within a vertical wellbore, but may have a different orientation during assembly, when removed from the wellbore, or in a deviated borehole Accordingly, relational descriptions are intended solely for convenience in facilitating reference to various components, but such relational aspects may be reversed, flipped, rotated, moved in space, placed in a diagonal orientation or position, placed horizontally or vertically, or similarly modified. Relational terms may also be used to differentiate between similar components; however, descriptions may also refer to certain components or elements using designations such as "first," "second," "third," and the like. Such language is also provided merely for differentiation purposes, and is not intended limit a component to a singular designation. As such, a component referenced in the specification as the "first" component may for some but not all embodiments be the same component referenced in the claims as a "first" component.

Furthermore, to the extent the description or claims refer to "an additional" or "other" element, feature, aspect, component, or the like, it does not preclude there being a single element, or more than one, of the additional element. Where the claims or description refer to "a" or "an" element, such reference is not be construed that there is just one of that element, but is instead to be inclusive of other components and understood as "one or more" of the element. It is to be understood that where the specification states that a component, feature, structure, function, or characteristic "may," "might," "can," or "could" be included, that particular component, feature, structure, or characteristic is provided in some embodiments, but is optional for other embodiments of the present disclosure. The terms "couple," "coupled," "connect," "connection," "connected," "in connection with," and "connecting" refer to "in direct connection with," "integral with," or "in connection with via one or more intermediate elements or members."

Although various example embodiments have been described in detail herein, those skilled in the art will readily appreciate in view of the present disclosure that many modifications are possible in the example embodiment without materially departing from the present disclosure. Accordingly, any such modifications are intended to be included in the scope of this disclosure. Likewise, while the disclosure herein contains many specifics, these specifics should not be construed as limiting the scope of the disclosure or of any of the appended claims, but merely as providing information pertinent to one or more specific embodiments that may fall within the scope of the disclosure and the appended claims. Any described features from the various embodiments disclosed may be employed in combination. In addition, other embodiments of the present disclosure may also be devised which lie within the scopes of the disclosure and the appended claims. Each addition, deletion, and modification to the embodiments that falls within the meaning and scope of the claims is to be embraced by the claims.

In the claims, means-plus-function clauses are intended to cover the structures described herein as performing the recited function, including both structural equivalents and equivalent structures. Thus, although a nail and a screw may not be structural equivalents in that a nail employs a cylindrical surface to couple wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

Certain embodiments and features may have been described using a set of numerical upper limits and a set of numerical lower limits. It should be appreciated that ranges including the combination of any two values. e.g., the combination of any lower value with any upper value, the combination of any two lower values, and/or the combination of any two upper values are contemplated unless otherwise indicated. Certain lower limits, upper limits and ranges ma appear in one or more claims below. Any numerical value is "about" or "approximately" the indicated value, and take into account experimental error and variations that would be expected by a person having ordinary skill in the art.

What is claimed is:

1. A method for drilling a lateral borehole, comprising:
positioning a deflection member within a wellbore, the deflection member having an inclined guide surface;
positioning a bit within the wellbore, the bit being coupled to a directional drilling system for selectively steering the bit, the directional drilling system including a plurality of expandable pads;
anchoring the deflection member within the wellbore;
guiding the bit over the guide surface of the deflection member, toward a sidewall of the wellbore for drilling of a lateral borehole; and
using the directional drilling system to elevate the bit relative to the guide surface to minimize contact between the bit and the deflection member, wherein using the directional drilling system includes selectively expanding the plurality of expandable pads against the inclined guide surface of the deflection member.

2. The method recited in claim 1, wherein positioning the deflection member and the bit occur in a single trip.

3. The method recited in claim 1, wherein positioning the deflection member includes selectively orienting the deflection member at a desired azimuth.

4. The method recited in claim 1, wherein anchoring the deflection member includes using hydraulic pressure to activate a setting assembly that includes one or more anchors.

5. The method recited in claim 1, wherein the deflection member is coupled to the bit, the method further comprising:
separating the bit from the deflection member.

6. The method recited in claim 1, wherein the directional drilling system includes a flexible rod extending through one or more eccentric rings.

7. The method recited in claim 1, wherein the deflection member is a whipstock.

8. The method recited in claim 1, further comprising:
drilling the lateral borehole using the bit.

9. The method recited in claim 8, wherein the wellbore is an openhole wellbore.

10. The method recited in claim 1, wherein using the directional drilling system to elevate the bit includes coordinating steering of the drill bit based on a location of the deflection member.

11. A method for drilling a lateral borehole in a single trip, comprising:
inserting a sidetracking assembly into a primary wellbore, the sidetracking assembly including a whipstock assembly coupled to a bottomhole assembly having a directional control system configured to steer a drill bit using a plurality of selectively expandable pads;
anchoring the whipstock assembly within the primary wellbore;
separating the whipstock assembly from the drill bit; and
drilling a lateral borehole using the drill bit, the directional drilling system controlling the drill bit by expanding the plurality of selectively expandable pads and thereby restricting contact of the drill bit with at least a ramped surface of the whipstock assembly.

12. The method recited in claim 11, wherein steering the drill bit includes elevating the drill bit off the ramped surface of the whipstock assembly over substantially a full length of the ramped surface of the whipstock assembly.

13. The method recited in claim 11, further comprising:
collecting information about a position or orientation of the whipstock assembly.

14. The method recited in claim 13, wherein steering the drill bit is conducted based on the collected information about the position or orientation of the whipstock assembly.

15. The method recited in claim 13, wherein collecting information about the position or orientation of the whipstock assembly includes collecting information about a location or orientation of a guide surface of the whipstock assembly.

16. The method recited in claim 11, wherein drilling the lateral borehole is performed at a predetermined build rate based at least in part on the directional drilling system and a length or angle of the ramped surface of the whipstock assembly.

17. A lateral borehole drilling system, comprising:
a drill bit;

a directional drilling system configured to selectively steer the drill bit, the directional drilling system including a plurality of selectively expandable pads;

a connector coupling the drill bit to a deflection member having a guide surface;

one or more sensors configured to determine a position of the drill bit relative to the deflection member; and one or more controllers responsive to the one or more sensors and configured to control the directional drilling system to elevate the drill bit relative to the guide surface of the deflection member.

18. The lateral wellbore drilling system recited in claim 17, wherein the one or more sensors are configured to collect information on one or both of position or orientation of the drill bit relative to the guide surface of deflection member.

* * * * *